US008484901B2

(12) United States Patent
Dawson

(10) Patent No.: US 8,484,901 B2
(45) Date of Patent: Jul. 16, 2013

(54) HINGES

(75) Inventor: John Dawson, Auckland (NZ)

(73) Assignee: Rochelle Leigh Clark, Auckland (NZ), part interest ( * ) Notice: Subject to any disclaimer, the term of this patent is extended or adjusted under 35 U.S.C. 154(b) by 258 days.

(21) Appl. No.: 12/734,631

(22) PCT Filed: Oct. 9, 2008

(86) PCT No.: PCT/NZ2008/000264

§ 371 (c)(1),
(2), (4) Date: Aug. 25, 2010

(87) PCT Pub. No.: WO2009/064196

PCT Pub. Date: May 22, 2009

(65) Prior Publication Data

US 2010/0319266 A1 Dec. 23, 2010

(30) Foreign Application Priority Data

Nov. 13, 2007 (NZ) ..... 563386

(51) Int. Cl.
*E05F 5/02* (2006.01)

(52) U.S. Cl.
USPC ..... 49/381; 49/506; 16/221; 16/382; 16/387

(58) Field of Classification Search
USPC ..... 49/381, 506; 16/221, 382, 387, 388, 16/398
See application file for complete search history.

(56) References Cited

U.S. PATENT DOCUMENTS

| | | | | | |
|---|---|---|---|---|---|
| 423,247 | A | | 3/1890 | Hastings | |
| D25,663 | S | | 6/1896 | Kipp | |
| 600,161 | A | | 3/1898 | Moore | |
| D30,022 | S | | 1/1899 | Behrens | |
| 1,634,181 | A | | 6/1927 | Flagg | |
| 3,172,167 | A | * | 3/1965 | Tugle | 49/400 |
| 3,349,428 | A | * | 10/1967 | Suska | 16/273 |
| 3,349,429 | A | * | 10/1967 | Suska | 16/275 |
| 3,445,883 | A | | 5/1969 | Lowe | |
| 4,351,085 | A | | 9/1982 | Suska | |
| D272,040 | S | | 1/1984 | Scanlan | |
| 4,882,809 | A | * | 11/1989 | Uppstrom | 16/384 |
| 5,133,152 | A | | 7/1992 | Grancagnolo | |
| 5,724,859 | A | | 3/1998 | Yamada | |

(Continued)

FOREIGN PATENT DOCUMENTS

| | | | |
|---|---|---|---|
| BR | PI 0605457-9 | | 7/2008 |
| CH | 678963 | A * | 11/1991 |

(Continued)

OTHER PUBLICATIONS

Catalogue—Cabinet Fittings—Hinges, http://web.archive.org/web/20050622031402/http://www.timbecon.com.au/products/hinges-432_0.aspx, Jun. 22, 2005, Timbecon Pty Ltd.

*Primary Examiner* — Jerry Redman
(74) *Attorney, Agent, or Firm* — Jacobson Holman PLLC

(57) ABSTRACT

A hinge set (and associated methodology and resultant hung doors or windows) where the leaf of each hinge sleeved component is, or is to be, leafwise received in, and is, or to be, screwed into, a different cavity, yet allowing aligned sleeve meshing for pin insertion. Its use allows the leaf to be largely concealed even when the doors or windows are open.

21 Claims, 3 Drawing Sheets

U.S. PATENT DOCUMENTS

| | | | |
|---|---|---|---|
| 5,873,847 | A | 2/1999 | Bennett |
| 5,940,937 | A | 8/1999 | Churchill |
| D414,393 | S | 9/1999 | Berg |
| 6,216,316 | B1 | 4/2001 | Errichiello |
| 6,810,938 | B2 | 11/2004 | Aquilina |
| D511,084 | S | 11/2005 | Georgopoulos |
| D566,519 | S | 4/2008 | Whinery |
| D611,324 | S | 3/2010 | Dawson |
| 2007/0220707 | A1* | 9/2007 | Eldon ..... 16/221 |

FOREIGN PATENT DOCUMENTS

| | | |
|---|---|---|
| FR | 2082385 | 12/1971 |
| FR | 2763631 | 11/1998 |
| GB | 17443 | 0/1903 |
| GB | 265560 | 10/1927 |

* cited by examiner 1
10
10
9
7
10
8
A
A
1
10
9
7
8
15
6
14
3
11
13
14
12
B
B
14
3
11
13
14
12
14

JAMB LEAF

PIN

DOOR LEAF

HINGES

This is a national stage of PCT/NZ08/000264 filed Oct. 9, 2008 and published in English, which has a priority of New Zealand no. 563386 filed Nov. 13, 2007, hereby incorporated by reference.

FIELD OF THE INVENTION

The present invention relates to hinges.

BACKGROUND OF THE INVENTION

Many different forms of hinge are known whereby one or more hinges can be used in order to articulate a member from another, by way of example, to articulate a door from a door jamb, to articulate a window from a window jamb or frame, etc.

SUMMARY OF THE INVENTION

The present invention relates to such hinges as well as hinges having other application.

A common type of hinge used for mounting doors or windows are so-called leaf hinges that have two main components each of a leaf and at lest one sleeve to receive the hinge pin, each engageable to the jamb or frame or the door and window by the use of penetrative fixers (such as screws) that pass normally through openings of the leaf. The one or more sleeve of each component is to align with the sleeve axis of a corresponding sleeve or sleeves of the other component, thereby to receive axially of the aligned sleeve axes, a hinge pin that provides the necessary articulation or pivot axis.

The present invention relates to an has an object hinges, members to associate therewith, etc whereby the hinge, when fitted in use, will be at least largely concealed, at least both when the door or window is open and when both the door and window is shut, save for the aligned sleeves and the hinge pin.

It is an object of the present invention to provide components of a hinge, a subassembly or assembly of such components to provide a hinge or sub assembly thereof, a hinge, a hinge kit, a hinged mounting of a member to articulate one relative to another, members to receive such hinge components, etc or to at least provide the public with a useful choice.

In an aspect the invention is a hinge assembly or a kit therefor comprising or including a first component being a leaf carrying at least one sleeve, a second component being a leaf carrying at least one sleeve, the second component being a complement to the first component, and a hinge pin through the sleeves or fittable through said sleeves when aligned, wherein at least one leaf is substantially plate-like (skeletal or not) with an actual or notional general plate plane and has at least one passageway therethrough coincident with and/or parallel to said general plate plane (notional or otherwise) for a fixing screw, and wherein the axis (or axes) of such leaf passageway(s) is (are) offset from, but is (or are) substantially normal to, the or each leafs sleeve axis, and wherein each general plate plane is at least substantially parallel to its leafs sleeve axis.

Preferably both a first and second component has more than one sleeve. Preferably at least one (and preferably both) components has (have) a leaf carrying two sleeves.

Preferably the offset of each plate plane general axis from its sleeve(s) is substantially the same, but complementary, thereby enabling hinge pin insertion through the sleeves of both components when complementing each other.

In another aspect the invention is a hinge assembly or a kit therefor comprising or including a first component being a leaf carrying at least one sleeve, a second component being a leaf carrying at least one sleeve, the second component being a complement to the first component, and a hinge pin through the sleeves or fittable through said sleeves when aligned;

wherein both components can have its leaf located in a routed cavity of a jamb, frame, door and/or window, and wherein each leaf is offset from its sleeve axis;

and wherein in use each leaf can extend into a said cavity at about 45° so that, in a closed condition, the two leafs are separated by about 90°.

Preferably both a first and second component has more than one sleeve.

Preferably at least one (and preferably both) components has (have) a leaf carrying two sleeves.

In an aspect the invention consists in a hinged assembly of one member (eg, a door or window) relative to another member (a door jamb, window frame or jamb, etc.) reliant on a hinge assembly of two components and a hinge pin, wherein each of said members has a routed or other receiving opening or cavity therein carrying a leaf of said component.

Preferably each component has a leaf and a retained in such an opening or cavity by a screw passing through the leaf.

In an aspect the invention is a hung door or window where its hinge, or hinges, has, or each has, a hinge leaf retained at about 45° (eg, plus or minus 10°) to the closed door or window.

The invention also consists in a method of hinging one member to another, said method comprising the steps of (i) fixing a leafed sleeve component of a hinge by its leaf in a cavity of a first member, (ii) fixing a leafed sleeve component of a hinge by its leaf in a cavity of the second member, and (iii) before or after step (ii) aligning the sleeves and inserting a hinge pin.

Preferably at least one of steps (i) and (ii) involves edgewise insertion into a door or window at about 45°.

Preferably both step (i) and (ii), or one of them, involves inserting at least one screw in and through the leaf of the component. In less preferred forms the leaf itself can be self retaining and/or adhered in a said cavity.

Preferably the hinge is a hinge assembly or hinge kit or combination of parts of the present invention.

The present invention also relates to a component or components of a hinge of any of the kinds herein described with reference to any one or more of the accompanying drawings.

The present invention also consists in a member to support the hinge and/or to support the hinged member which has a leaf receiving cavity substantially as herein described with reference to any one or more of the accompanying drawings.

In yet a further aspect, the invention consists in a method of hinging which involves the use of the present invention in a manner substantially as herein described with reference to any one or more of the accompanying drawings.

In still a further aspect, the invention consists in a hinge assembly, irrespective of the number of sleeves on each component, but provided they are compatible, substantially as herein described with reference to any one or more of the accompanying drawings.

BRIEF DESCRIPTION OF THE DRAWINGS

A preferred form of the present invention will now be described with reference with the accompanying drawings in which.

DETAILED DESCRIPTION OF THE PREFERRED EMBODIMENTS

Hinges of the present invention are preferably made by machining the first and second components from an extruded member. Alternatively, the overall hinge can be moulded or otherwise made. The hinge pin preferably is turned or moulded or press formed.

Suitable materials include metals such as steel, brass, aluminium and the like. For some uses, extruded aluminium members may be machined to provide the first and second component. Likewise the hinge pin although, if desired the hinge pin can be of a dissimilar material. Moreover, if desired, each of the first and second components can be of a different material.

Figure 13:
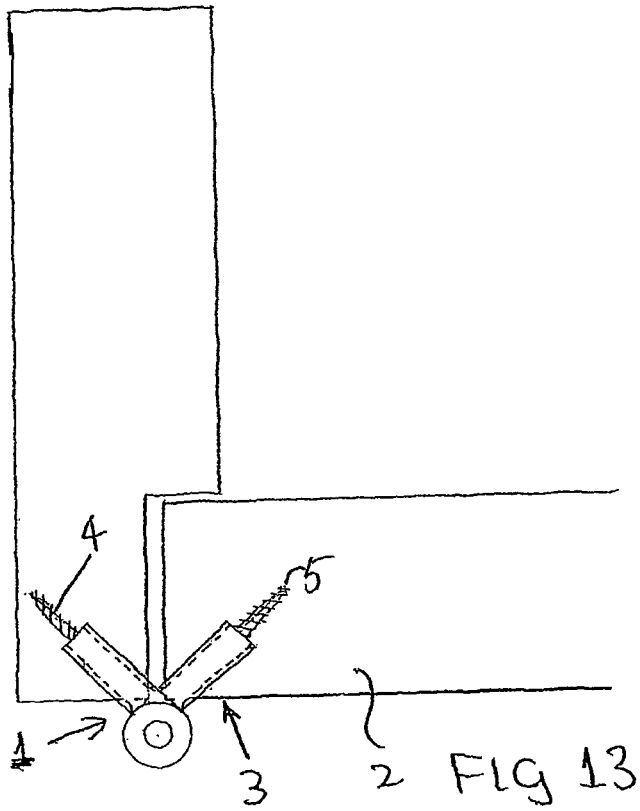
FIG. 13 is a diagrammatic view of a door or window jamb and a closed door or window with the assembly as in FIGS. 9 and 10 having the leaf of each of the two components received edgewise within a routed cavity of each of the jamb and door/window respectively and fixed thereto by penetrative fasteners (eg, screws) passing into, through and beyond the respective passageways of each of the first and second components.
Figure 14:
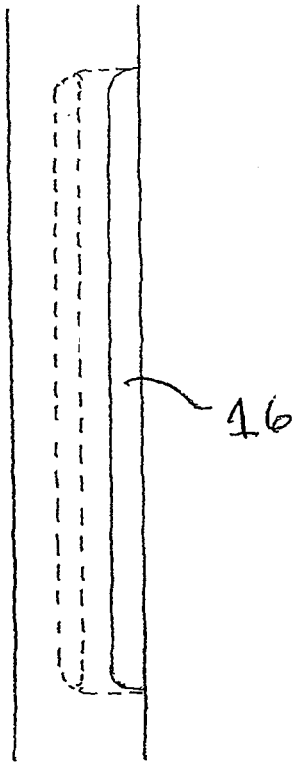
FIG. 14 shows a routed recess and its extent when viewed in elevation.

A routed cavity 16, preferably at about 45° is shown in FIGS. 13 and 14. It is provided to receive, for a first component 1, most of the leaf region thereof. Likewise a 45° or thereabouts cavity in the door 2 to receive the leaf of the second component 3. A shown a hinge pin can hold the aligned and interposing sleeves of components 1 and 3 in register to allow pivoting one relative to the other.

Shown in FIG. 13 are the screws 4 of the first component 1 and the screws 5 of the second component 3.

Figure 9:
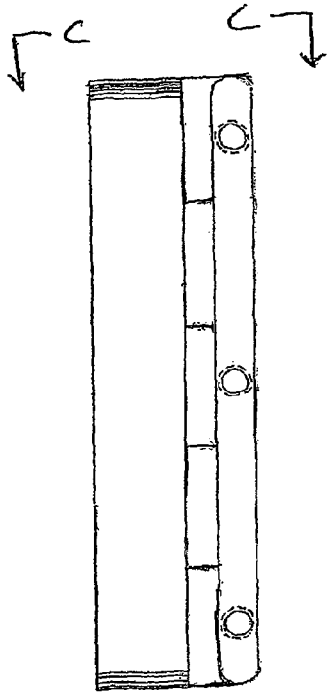
FIG. 9 is an assembly of the components of FIGS. 1 to 7 in one mode to a component of FIG. 5.
Figure 11:
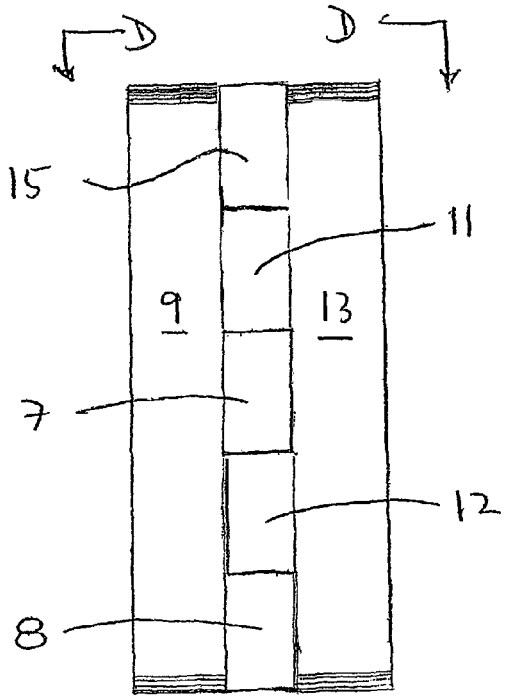
FIG. 11 is the same component as in FIGS. 9 and 10 but with the general planes of the first and second component substantially aligned.
Figure 10:
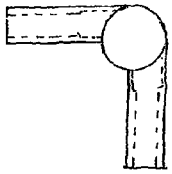
FIG. 10 is a view CC of the assembly of FIG. 9.
Figure 12:
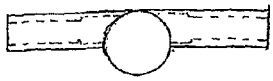
FIG. 12 is a view DD of the assembly of FIG. 11.

Preferably the view is not as in FIGS. 9 and 10 but rather has one of the leafs rotated by 180° from that condition so that it is essentially only the revealed regions of the hinge pin 6 and the aligned sleeves that can be seen. See FIG. 13 in this respect.

Figures 1, 2, 3, 4, 5, 6, 7, 8:
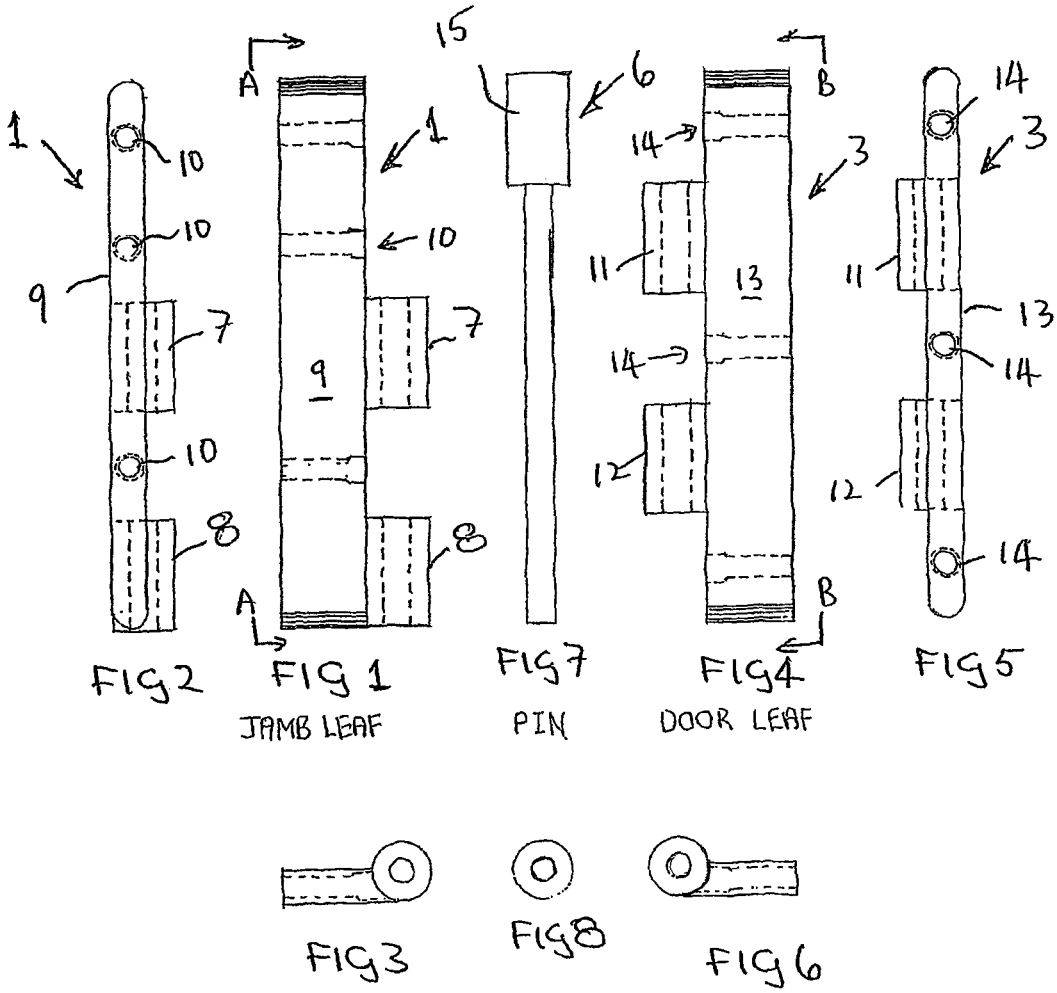
FIG. 1 is a side elevational view of a first component of a hinge in accordance with the present invention, such component to 2 sleeves in alignment from a non-skeletal leaf which has in the leaf fitting passageways to receive an appropriately configured screw.
FIG. 2 is a view AA of the component of FIG. 1.
FIG. 3 is a bottom view of the component of FIGS. 1 and 2.
FIG. 4 shows the complimentary component to that of FIGS. 1 to 3, such component again having a leaf with fitting passageways in the leaf (but not normal to the general plane or planes of the leaf) and also carrying two sleeves, such sleeves being able to mesh with those of the component of FIGS. 1 to 3.
FIG. 5 is a view BB of the component of FIG. 4.
FIG. 6 is a view from below of the component of FIGS. 4 and 5.
FIG. 7 is an elevational view of a hinge pin having a head region to match the outer circumference of the sleeves of the components of FIGS. 1 to 3 and 4 to 6.
FIG. 8 is a top view of the hinge pin of FIG. 7.

Shown in FIG. 1 are sleeves 7 and 8, the leaf 9 and the screw receiving passageways 10.

Likewise for the component 3, there are sleeves 11 and 12, the leaf 13 and screw receiving passageways 14. The head 15 of the hinge pin 6 can be seen as if were part of the sleeve sequence.

For heavy applications, or as an alternative method of fixing, it is possible to insert an insert nut in the bottom of the routered cavity for the purpose of using machine screws for fixing.

If desired a hex head screw can be used for fixing, making it easier to engage the head of the screw in the countersunk portion of the leaf, as a standard Phillips or Pozi Drive screw head of the size required would be difficult to get the degree of fixing without wearing or stripping the screw head.

In manufacture from certain materials, there can be the insertion of a nylon or plastic sleeve inside the sleeve for the hinge pin to reduce friction on the hinge pin, and the insertion of a nylon or plastic load bearing material between the sleeve ("knuckles") to act as a washer. This is desirable in aluminium hinges.

A suitable fitting sequence is to jig machine router appropriate cavities in the jamb joinery and the door and/or window. Thereafter the components 1 and 3 can each be fitted and prior to hinge pinning of the components one to the other.

The invention claimed is:

1. A hinge kit comprising a first component being a leaf carrying at least one sleeve, a second component being a leaf carrying at least one sleeve, the second component being a complement to the first component, each sleeve having a respective sleeve axis, and a hinge pin through the sleeves or fittable through said sleeves when aligned, wherein at least one leaf includes a substantially planar plate and has at least one passageway therethrough, the axis of the passageway extending in the same direction as the plane of the plate, the passageway being arranged to receive a penetrative fastener to mount the leaf to at least one of a jamb, frame, door and window, and wherein the or each leaf passageway axis is offset from, but is substantially normal to, the or each leafs sleeve axis, and wherein each plate is at least substantially parallel to the sleeve axis of the sleeve of the plate.

2. The hinge kit of claim 1, wherein both the first and second component has more than one sleeve.

3. The hinge kit of claim 2, wherein at least one components has a leaf carrying two sleeves.

4. The hinge kit of claim 3, wherein both components have at least two sleeves.

5. The hinge kit of claim 1, wherein the offset of each plate from the sleeves of the plate is substantially identical, but complementary, thereby enabling hinge pin insertion through the sleeves of both components when complementing each other.

6. The hinge kit of claim 1, wherein the at least one passageway is coincident with the plane of the plate.

7. The hinge kit of claim 1, wherein the at least one passageway is parallel to the plane of the plate.

8. The hinge kit of claim 1, wherein the substantially planar plate is a skeletal plate.

9. A hinge assembly comprising a first component being a leaf carrying at least one sleeve, a second component being a leaf carrying at least one sleeve, the second component being a complement to the first component, each sleeve having a respective sleeve axis, and a hinge pin arranged to extend through the sleeves when the sleeves are aligned, at least one leaf including a substantially planar plate and having at least one passageway therethrough, an axis of the passageway extending in a same direction as the plane of the plate, the passageway being arranged to receive a penetrative fastener to mount the leaf to at least one of a jamb, frame, door and window, wherein the leaf of both components can be located in a respective routed cavity of at least one of a jamb, frame, door and window, and wherein each leaf is offset from the sleeve axis of the leaf, and wherein in use each leaf can extend into said cavity at about 45° so that, in a closed condition, the two leafs are separated by about 90°.

10. The hinge assembly of claim 9, wherein both the first and second component has more than one sleeve.

11. The hinge assembly of claim 10, wherein at least one component has a leaf carrying two sleeves.

12. The hinge assembly of claim 11, wherein both components has at least two sleeves.

13. The hinge assembly of claim 12, further comprising a closure member and a frame member, wherein each of said members has a receiving cavity therein carrying a leaf of a respective component.

14. The hinge assembly of claim 13, wherein each component has a leaf and is retained in the receiving cavity by a screw passing through the leaf.

15. The hinge assembly of claim 13, wherein the closure member is a door.

16. The hinge assembly of claim 13, wherein the closure member is a window.

17. A method of hinging a first member to a second member using at least one hinge, said method comprising the steps of:

(i) fixing a leaf of a first leafed sleeve component of the hinge in a cavity of a first member, the first leafed sleeve component having a sleeve, (ii) fixing a leaf of a second leafed sleeve component of the hinge in a cavity of the second member, the second leafed sleeve component having a sleeve, and at least one leaf including a substantially planar plate having at least one passageway therethrough, an axis of the passageway extending in a same direction as a plane of the plate, and (iii) before or after step (i) or (ii), aligning the sleeves and inserting a hinge pin, and (iv) before or after step (ii), inserting at least one penetrative fastener through the passageway so as to mount the at least one leaf to the first or second member.

18. The method of claim 17, wherein at least one of steps (i) and (ii) involves edgewise insertion into a door or window at about 45°.

19. The method of claim 17, wherein at least one leaf is self retaining in its said cavity.

20. The method of claim 17, wherein at least one leaf is adhered in the cavity of the first or second member.

21. A method of hinging a first member to a second member using the hinge kit of claim 1, said method comprising the steps of:

(i) fixing the leaf of the first component in a cavity of the first member, (ii) fixing the leaf of the second component in a cavity of the second member, and before or after step (i) or (ii), aligning the sleeves and inserting a hinge pin.

* * * * *

UNITED STATES PATENT AND TRADEMARK OFFICE

CERTIFICATE OF CORRECTION

PATENT NO. : 8,484,901 B2
APPLICATION NO. : 12/734631
DATED : July 16, 2013
INVENTOR(S) : John Dawson It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 362 days.

Signed and Sealed this
Eighth Day of September, 2015

Michelle K. Lee

Michelle K. Lee
*Director of the United States Patent and Trademark Office*